US010932051B2

(12) United States Patent
Chen et al.

(10) Patent No.: US 10,932,051 B2
(45) Date of Patent: Feb. 23, 2021

(54) SPEAKER

(71) Applicant: AAC ACOUSTIC TECHNOLOGIES (SHENZHEN) CO., LTD., Shenzhen (CN)

(72) Inventors: Zhaoxian Chen, Shenzhen (CN); Rongrong Wu, Shenzhen (CN); Lubin Mao, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/527,069

(22) Filed: Jul. 31, 2019

(65) Prior Publication Data

US 2020/0045444 A1 Feb. 6, 2020

(30) Foreign Application Priority Data

Aug. 3, 2018 (CN) ..... 201821255814.X

(51) Int. Cl.

| | |
|---|---|
| ***H04R 9/04*** | (2006.01) |
| ***H04R 9/06*** | (2006.01) |
| ***H04R 9/02*** | (2006.01) |
| ***H01F 7/08*** | (2006.01) |

(52) U.S. Cl.

CPC ..... *H04R 9/04* (2013.01); *H01F 7/081* (2013.01); *H04R 9/025* (2013.01); *H04R 9/06* (2013.01)

(58) Field of Classification Search

CPC .. H04R 9/04; H04R 9/025; H04R 9/06; H01F 7/081

USPC ..... 381/412

See application file for complete search history.

(56) References Cited

U.S. PATENT DOCUMENTS

| | | | | |
|---|---|---|---|---|
| 9,131,304 | B2 * | 9/2015 | Sakaguchi | H04R 9/025 |
| 2010/0316249 | A1 * | 12/2010 | Kamimura | H04R 9/043 381/399 |
| 2014/0079258 | A1 * | 3/2014 | Fujise | H04R 9/06 381/312 |
| 2015/0117699 | A1 * | 4/2015 | Cai | H04R 9/025 381/412 |

* cited by examiner

*Primary Examiner* — Sean H Nguyen

(74) *Attorney, Agent, or Firm* — W&G Law Group LLP

(57) ABSTRACT

The present disclosure provides a speaker. The speaker includes a basket having an accommodating space, a vibration system and a magnetic circuit system which are accommodated in the accommodating space. The magnetic circuit system includes a yoke fixedly connected to the basket, a main magnetic steel assembled to the middle of the yoke, and a main pole core attached to a surface of the magnet away from the yoke. The main magnetic steel has a first leakage hole formed in a vibration direction of the vibration system, and the main pole core has a second leakage hole formed at a position corresponding to the first leakage hole. The first leakage hole and the second leakage hole are in communication with each other.

16 Claims, 7 Drawing Sheets

SPEAKER

TECHNICAL FIELD

The present disclosure relates to electroacoustic conversion technology, and in particular, to a speaker.

BACKGROUND

Quality of a designed speaker as a voice playing apparatus directly influences voice performance of products such as mobile communication devices. A speaker includes a vibration system and a magnetic circuit system which is configured to drive the vibration system to vibrate and produce sound. To meet market demands for thin speakers having higher sound quality, higher requirements are imposed on design of the magnetic circuit system of the speaker.

In related technologies, a magnetic circuit system of a speaker includes a yoke, a main magnetic steel assembled to the yoke, and a main pole core attached to the main magnetic steel. Both the main magnetic steel and the main pole core are complete cuboid solid structures, and such a design provides a poor sound effect and excessive high frequency noise.

Therefore, it is necessary to provide a new speaker to address the foregoing limitations.

BRIEF DESCRIPTION OF THE DRAWINGS

To describe technical solutions of embodiments of the present disclosure more clearly, the following briefly introduces accompanying drawings for describing the embodiments. Obviously, the accompanying drawings in the following description are only some embodiments of the present disclosure, and a person of ordinary skill in the art may still obtain other drawings from these accompanying drawings without creative efforts.

DETAILED DESCRIPTION

The following clearly and completely describes technical solutions in embodiments of the present disclosure with reference to accompanying drawings in the embodiments of the present disclosure. Obviously, the described embodiments are only some embodiments rather than all embodiments of the present invention. All other embodiments obtained by a person skilled in the art based on the embodiments of the present disclosure without creative efforts shall fall within the protection scope of the present disclosure.

Embodiment 1

Figure 1:
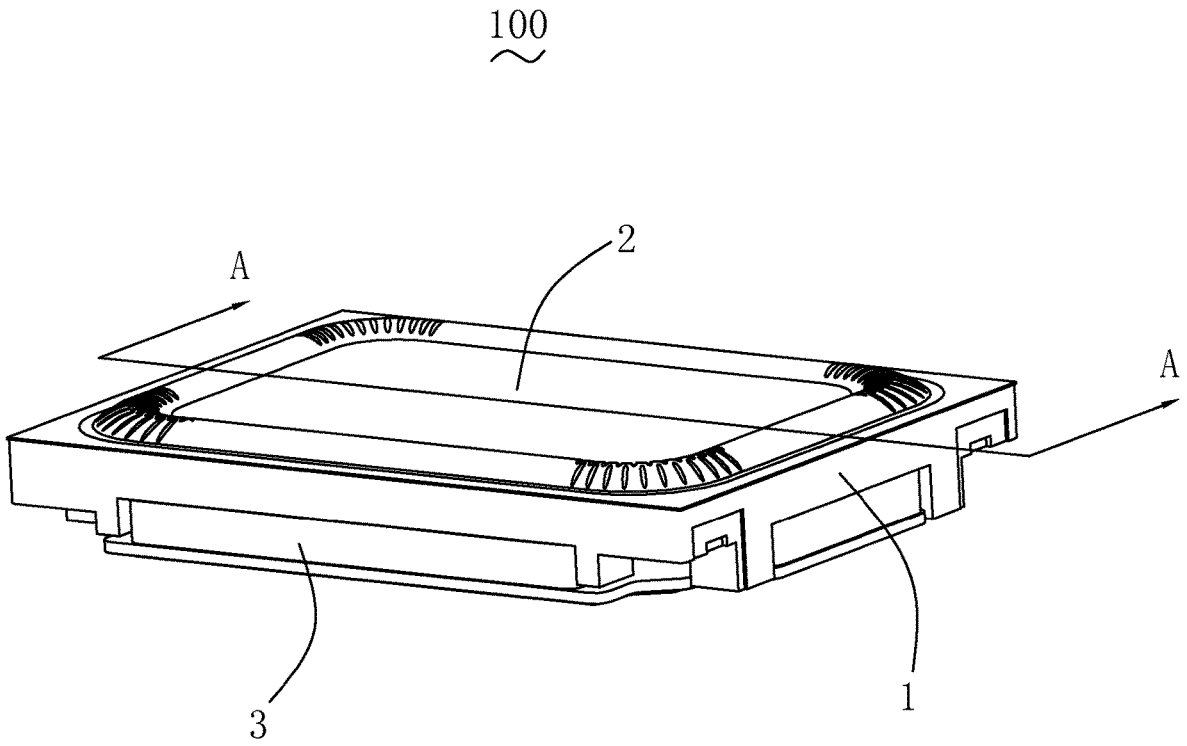
FIG. 1 is a schematic three-dimensional structural view of a speaker according to Embodiment 1 of the present disclosure.
Figure 2:
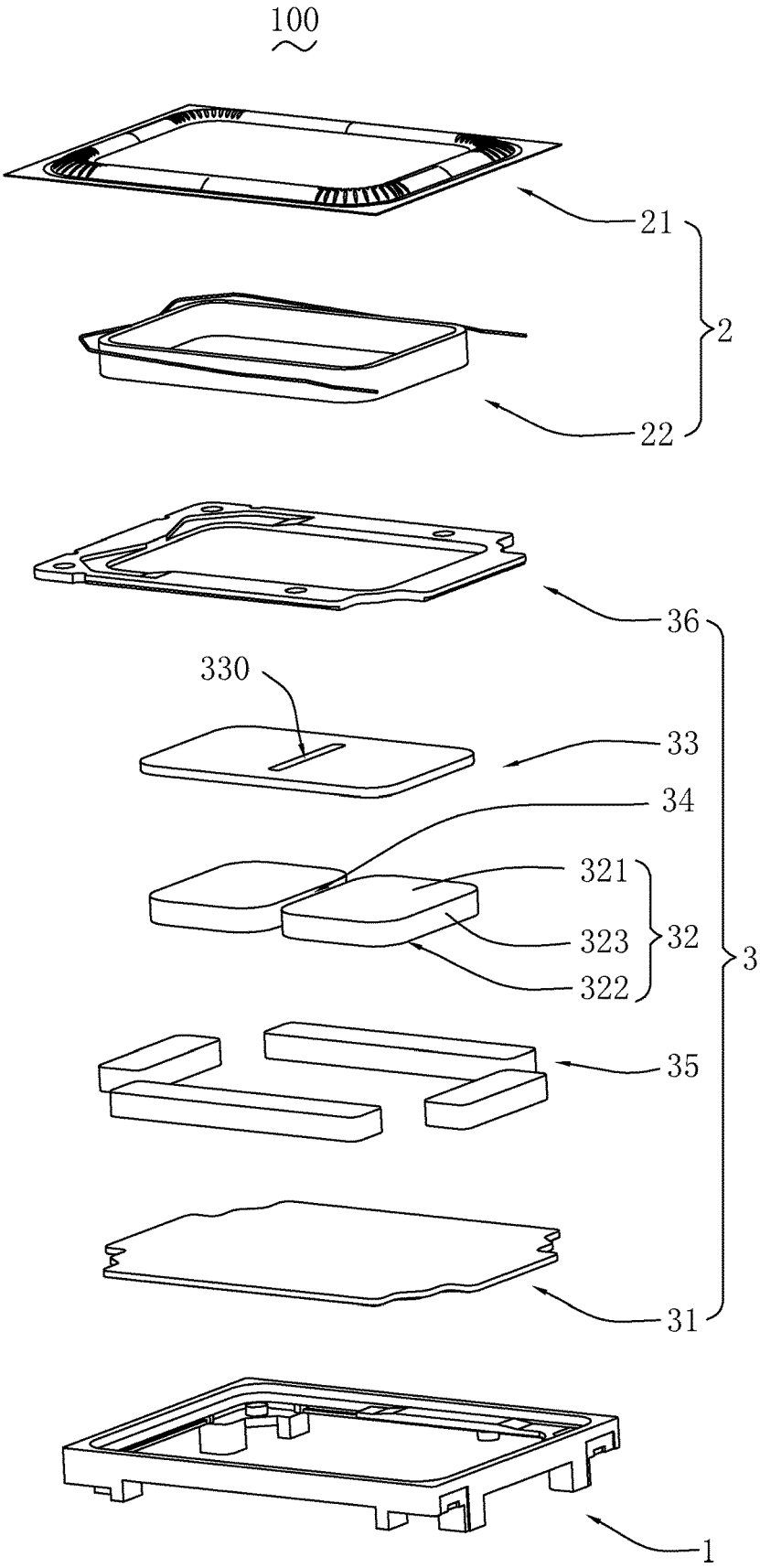
FIG. 2 is a structural exploded view of a speaker shown in FIG. 1.
Figure 3:
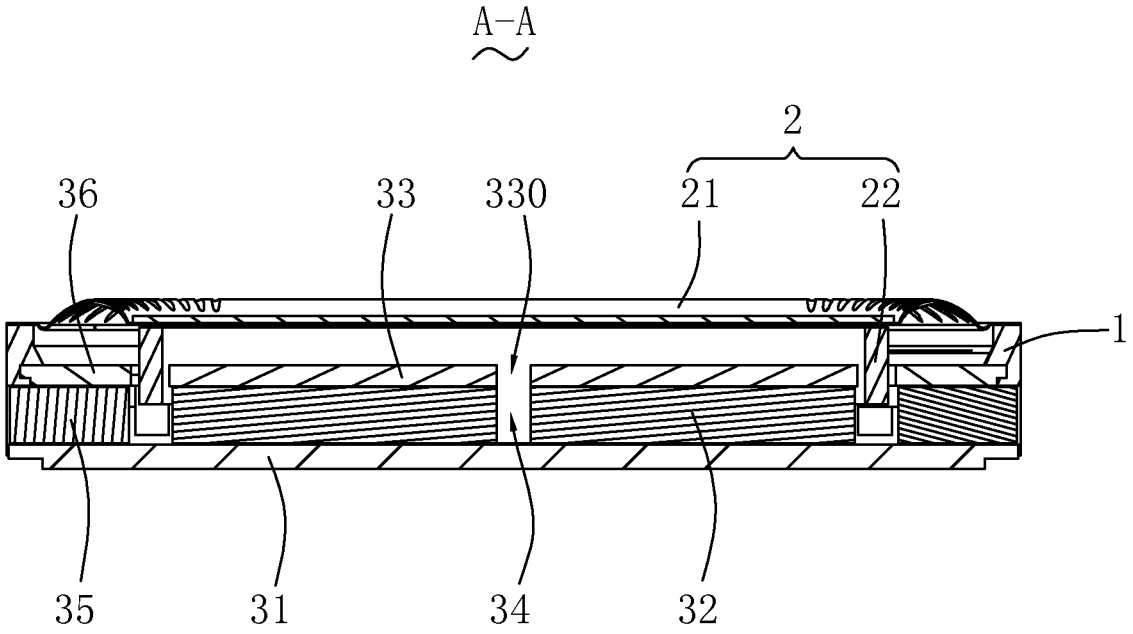
FIG. 3 is a sectional view of a speaker along an A-A line shown in FIG. 1.

Referring to FIGS. 1-3, the present disclosure provides a speaker 100. The speaker 100 includes a basket 1 having an accommodating space, a vibration system 2 and a magnetic circuit system 3 which are accommodated in the accommodating space.

The vibration system 2 is configured to vibrate and produce sound. Specifically, the vibration system 2 includes a diaphragm 21 configured to vibrate and produce sound and a voice coil 22 located below the diaphragm 21 and configured to drive the diaphragm 21 to vibrate and produce sound.

The magnetic circuit system 3 is configured to drive the vibration system 2 to vibrate and produce sound. Specifically, the magnetic circuit system 3 includes a yoke 31 fixedly connected to the basket 1, at least two main magnetic steels 32 assembled to the middle of the yoke 31, a main pole core 33 attached to a surface of the main magnetic steel 32, a first leakage hole 34 formed by two neighboring main magnetic steels 32 which are separated from each other, an auxiliary magnetic steel 35 disposed around the main magnetic steel 32, and an auxiliary pole core 36 attached to the auxiliary magnetic steel.

The main magnetic steel 32 and the auxiliary magnetic steel 35 form a magnetic gap together, and the voice coil 22 is suspended in the magnetic gap. The main pole core 33 and the auxiliary pole core 36 are made of magnetic conductive materials and have a function of magnetic conduction.

The main magnetic steel 32 is a rectangular block structure, and includes a top wall 321 close to the main pole core 33, a bottom wall 322 disposed opposite to the top wall 321, and a side wall 323 connecting the top wall 321 and the bottom wall 322. The main pole core 33 abuts against the top wall 321, and the bottom wall 322 abuts against the yoke 31. The first leakage hole 34 is formed by two neighboring main magnetic steels 32 which are separated from each other, and an extending direction of the first leakage hole 34 is consistent with a vibration direction of the vibration system 2.

In another embodiment, a quantity of the main magnetic steels 32 may also be greater than two, and a quantity of the first leakage holes 34 is also greater than 1 correspondingly, but this does not affect correct expression of content of the present disclosure, and still falls within the protection scope of the present disclosure.

The main pole core 33 has a second leakage hole 330 formed at a position corresponding to the first leakage hole 34. The second leakage hole 330 completely penetrates through two sides of the main pole core 33, and the second leakage hole 330 and the first leakage hole 34 are in communication with each other. The second leakage hole 330 and the first leakage hole 34 balance air pressure in the speaker 100 together, so as to significantly improve sound effect of the speaker 100.

Preferably, a quantity of the second leakage hole 330 is the same as that of the first leakage hole 34. In this embodiment, a quantity of the second leakage hole 330 is also one. Central axes of the second leakage hole 330 and the first leakage hole 34 are in the same straight line. A projection of the second leakage hole 330 on the yoke 31 in the central axis completely falls into a range of a projection of the first leakage hole 34 on the yoke 31 in the central axis. In other words, an opening area of the second leakage hole 330 is less than that of the first leakage hole 34.

It can be understood that, the first leakage hole 34 and the second leakage hole 330 are provided to lower high frequency noise, improve the sound effect of the speaker 100, save materials for manufacturing the speaker 100, save costs, reduce an entire weight of the speaker 100, and meet a miniaturization requirement of the speaker 100.

Figure 4:
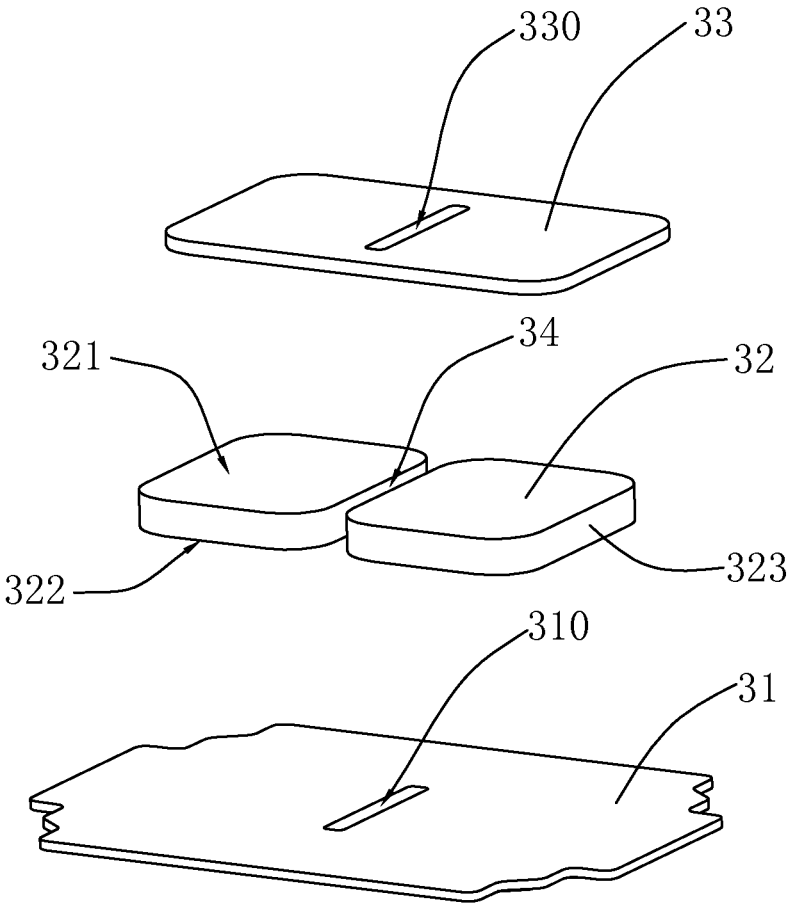
FIG. 4 is a structural exploded view of another main pole core, another main magnetic steel, and another yoke in Embodiment 1 of the present disclosure.
Figure 5:
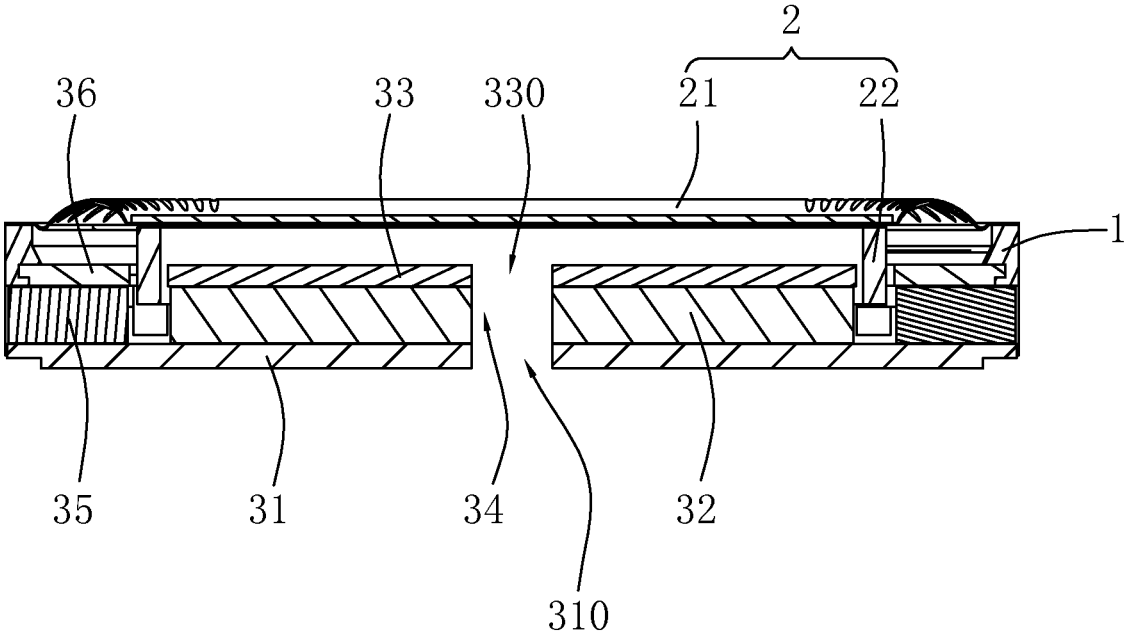
FIG. 5 is a sectional view of another speaker according to Embodiment 1 of the present disclosure.

Referring to FIG. 4 and FIG. 5, further, in another embodiment, the yoke 31 may further have a third leakage hole 310 formed at a position corresponding to the first leakage hole 34. The third leakage hole 310 and the first leakage hole 34 are in communication with each other. The third leakage hole 310 balances air pressure in the speaker 100 together with the second leakage hole 330 and the first leakage hole 34, to further improve the sound effect of the speaker 100.

The third leakage hole 310 completely penetrates through two sides of the yoke 31. A quantity of the third leakage hole 310 is the same as that of the first leakage hole 34. Preferably, a quantity of the third leakage holes 310 is also one. Central axes of the third leakage hole 310, the first leakage hole 34, and the second leakage hole 330 are in the same straight line. In addition, a projection of the third leakage hole 310 and a projection of the second leakage hole 330 on the diaphragm in the central axes fall completely into a range of a projection of the first leakage hole 34 on the diaphragm in the central axis respectively. In other words, an opening area of the third leakage hole 310 and an opening area of the second leakage hole 330 are respectively less than an opening area of the first leakage hole 34.

Embodiment 2

Figure 6:
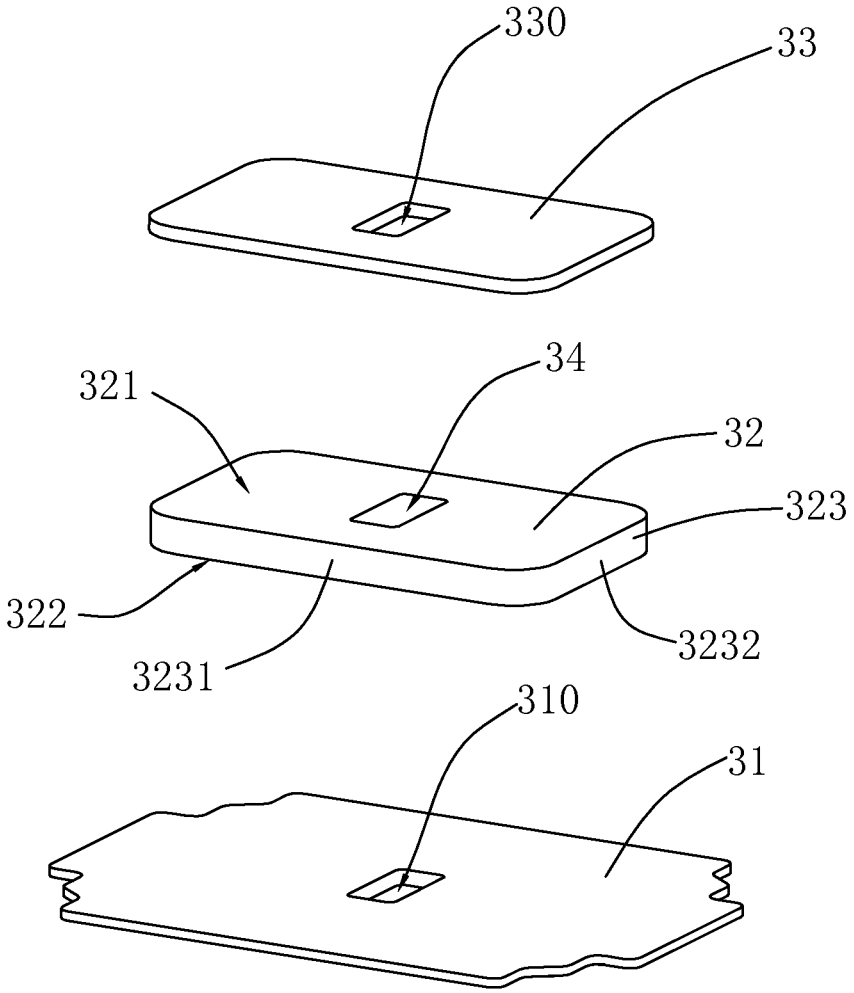
FIG. 6 is a structural exploded view of a main pole core, a main magnetic steel, and a yoke in Embodiment 2 of the present disclosure.
Figure 7:
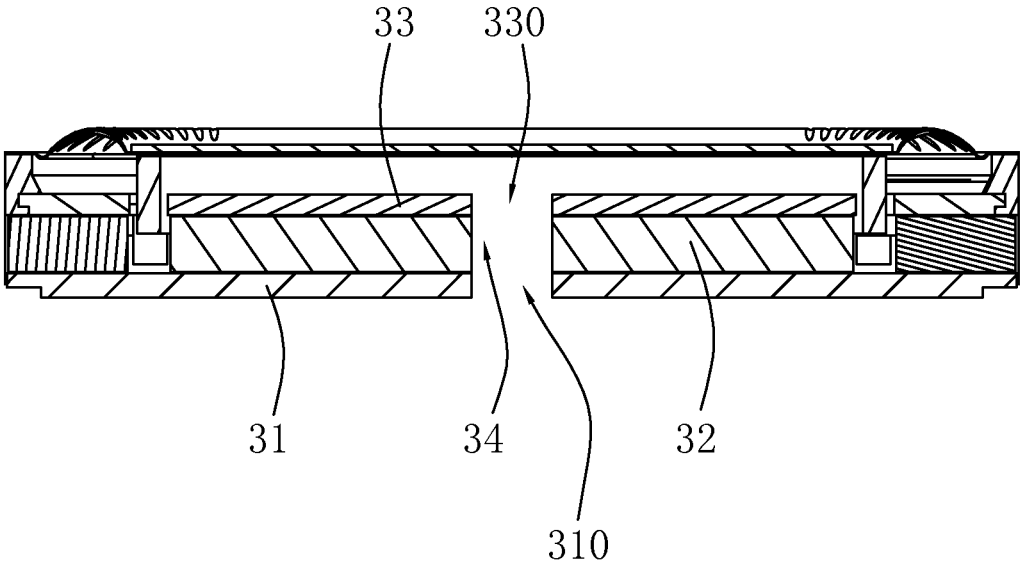
FIG. 7 is a sectional view of a speaker according to Embodiment 2 of the present disclosure.

Referring to FIG. 6 and FIG. 7, this embodiment provides a speaker. Differences between this embodiment and Embodiment 1 are as follows.

In this embodiment, a quantity of the main magnetic steel 32 is one, and the first leakage hole 34 is formed by penetrating through the top wall 321 and the bottom wall 322. In other words, the first leakage hole 34 is completely formed inside the main magnetic steel 32.

The side wall 323 includes two long side walls 3231 disposed in parallel to and separately from each other and two short side walls 3232 disposed at two ends of the long side walls 3231 and connecting the two long side walls 3231. The two short side walls 3232 are also disposed in parallel to and separately from each other.

The first leakage hole 34 includes two first hole walls disposed in parallel to and separately from with the long side walls 3231 and two second hole walls disposed at two ends of the first hole walls and connecting the two first hole walls. The second hole walls are disposed in parallel to and separately from the short side walls 3232.

Preferably, a quantity of the first leakage holes 34, a quantity of the second leakage holes 330, and a quantity of the third leakage holes 310 are all one. The first leakage hole 34 is a rectangular opening, and is disposed exactly in the middle of the main magnetic steel 32. Central axes of the first leakage hole 34, the second leakage hole 330, and the third leakage hole 310 are in the same straight line. Further, a projection of the first leakage hole 34, a projection of the second leakage hole 330, and a projection of the third leakage hole 310 on the diaphragm in the central axes completely coincide. In other words, the first leakage hole 34, the second leakage hole 330, and the third leakage hole 310 have the same opening areas.

In this embodiment, other structures of the speaker are all consistent with the speaker in Embodiment 1. Details are not described in this embodiment.

Compared with related technologies, with respect to the speaker in the present disclosure, the main magnetic steel 32 has a first leakage hole 34 formed in a vibration direction of the vibration system 2, and the main pole core 33 has a second leakage hole 330 in communication with the first leakage hole 34. The first leakage hole 34 and the second leakage hole 330 balance the air pressure in the speaker 100 together to lower the high frequency noise, so as to significantly improve acoustic performance of the speaker.

The above descriptions are merely embodiments of the present disclosure, and it should be noted that a person of ordinary skill in the art can make improvements without departing from the inventive concept of the present disclosure, and all such improvements shall fall within the protection scope of the present disclosure.

What is claimed is:

1. A speaker, comprising a basket having an accommodating space, a vibration system and a magnetic circuit system which are accommodated in the accommodating space, wherein the magnetic circuit system comprises a yoke fixedly connected to the basket, a main magnetic steel assembled to the middle of the yoke, and a main pole core attached to a surface of the main magnetic steel away from the yoke, wherein the main magnetic steel has a first leakage hole formed in a vibration direction of the vibration system, the main pole core has a second leakage hole formed at a position corresponding to the first leakage hole, and the first leakage hole and the second leakage hole are in communication with each other to balance air pressure in the speaker;

wherein the main magnetic steel is a rectangular block structure, and comprises a top wall connected to the main pole core, a bottom wall disposed opposite to the top wall, and a side wall connecting the top wall and the bottom wall, wherein the bottom wall abuts against the yoke;

wherein a quantity of the main magnetic steel is at least two, and the side walls of two neighboring main magnetic steels are disposed separately from each other to form the first leakage hole, and a quantity of the second leakage hole is the same as that of the first leakage hole;

wherein the magnetic circuit system further comprises an auxiliary magnetic steel disposed around the main magnetic steel and an auxiliary pole core attached to the auxiliary magnetic steel, wherein the main magnetic steel and the auxiliary magnetic steel are disposed separately from each other to form a magnetic gap.

2. The speaker according to claim 1, wherein a quantity of the main magnetic steel is one, and the first leakage hole penetrates through the top wall and the bottom wall in the vibration direction of the vibration system.

3. The speaker according to claim 2, wherein the side wall comprises two long side walls disposed in parallel to and separately from each other and two short side walls disposed at two ends of the long side walls and connecting the two long side walls, and the first leakage hole is a rectangular opening, and comprises two first hole walls disposed in parallel to and separately from the long side walls and two second hole walls disposed at two ends of the first hole walls and connecting the two first hole walls, wherein the second hole walls are disposed in parallel to and separately from the short side walls.

4. The speaker according to claim 3, wherein a quantity of the first leakage holes is one, and the first leakage hole is disposed exactly in the middle of the main magnetic steel.

5. The speaker according to claim 4, wherein the yoke has a third leakage hole formed at a position corresponding to the first leakage hole, and the third leakage hole and the first leakage hole are in communication with each other.

6. The speaker according to claim 5, wherein central axes of the first leakage hole, the second leakage hole, and the third leakage hole are in the same straight line.

7. The speaker according to claim 3, wherein the yoke has a third leakage hole formed at a position corresponding to the first leakage hole, and the third leakage hole and the first leakage hole are in communication with each other.

8. The speaker according to claim 7, wherein central axes of the first leakage hole, the second leakage hole, and the third leakage hole are in the same straight line.

9. The speaker according to claim 2, wherein the yoke has a third leakage hole formed at a position corresponding to the first leakage hole, and the third leakage hole and the first leakage hole are in communication with each other.

10. The speaker according to claim 9, wherein central axes of the first leakage hole, the second leakage hole, and the third leakage hole are in the same straight line.

11. The speaker according to claim 1, wherein the yoke has a third leakage hole formed at a position corresponding to the first leakage hole, and the third leakage hole and the first leakage hole are in communication with each other.

12. The speaker according to claim 11, wherein central axes of the first leakage hole, the second leakage hole, and the third leakage hole are in the same straight line.

13. The speaker according to claim 1, wherein the yoke has a third leakage hole formed at a position corresponding to the first leakage hole, and the third leakage hole and the first leakage hole are in communication with each other.

14. The speaker according to claim 13, wherein central axes of the first leakage hole, the second leakage hole, and the third leakage hole are in the same straight line.

15. The speaker according to claim 1, wherein the yoke has a third leakage hole formed at a position corresponding to the first leakage hole, and the third leakage hole and the first leakage hole are in communication with each other.

16. The speaker according to claim 15, wherein central axes of the first leakage hole, the second leakage hole, and the third leakage hole are in the same straight line.

* * * * *